United States Patent [19]

May

[11] Patent Number: 4,643,642

[45] Date of Patent: Feb. 17, 1987

[54] MULTI-BLADED PROPELLER AND SHAFT ASSEMBLY

[75] Inventor: Eric R. May, Altrincham, United Kingdom

[73] Assignee: Vickers Public Limited Company, Millbank, London, England

[21] Appl. No.: 729,174

[22] Filed: Apr. 30, 1985

[30] Foreign Application Priority Data

Sep. 17, 1984 [GB] United Kingdom ..... 8423433

[51] Int. Cl.[4] ..... F01D 1/36; F03B 5/00

[52] U.S. Cl. ..... 416/90 A; 416/93 A; 137/580

[58] Field of Search ..... 416/90 A, 90 R, 92, 416/93 A, 93 R, 20 R, 231 R; 440/89, 88; 137/580; 277/157, 3, 165

[56] References Cited

U.S. PATENT DOCUMENTS

| | | | |
|---|---|---|---|
| 1,097,991 | 5/1914 | Sawyer | 416/90 A |
| 2,707,388 | 5/1955 | Kent | 277/157 |
| 3,172,671 | 3/1965 | Downs | 277/157 |
| 4,188,906 | 2/1980 | Tachmindji et al. | 416/90 A |
| 4,218,185 | 8/1980 | Trytek | 416/20 R |
| 4,481,976 | 11/1984 | Cyphelly | 137/580 |

FOREIGN PATENT DOCUMENTS

| | | | |
|---|---|---|---|
| 135393 | 10/1981 | Japan | 416/90 A |
| 522782 | 9/1976 | U.S.S.R. | 137/580 |

*Primary Examiner*—Louis J. Casaregola
*Assistant Examiner*—Donald E. Stout
*Attorney, Agent, or Firm*—Shoemaker and Mattare, Ltd.

[57] ABSTRACT

A multi-bladed propeller and shaft assembly is provided in which air can be fed to the propeller blades to reduce the effects of cavitation. A shaft leads to a multi-bladed propeller and carries a sleeve formed with inlet passages and axial and radial passages leading to the respective blades. A slip ring supported in an anti-rotation device allows the shaft sleeve to rotate within axially spaced bearings of the slip ring. Axially spaced air seals together define with the body of the slip ring an annulus within which inlet passages rotate. Each seal is formed as a multiplicity of arcuate segments resiliently biased towards the sleeve and having movably sealed end face portions to maintain pressure tightness. The body further has a radial flow passage for admission of air under pressure to the annular space and a flexible fluid connector connects the radial flow passage to an air supply line leading from the hull structure. The present shaft delivery slip ring avoids the need to feed air down the whole length of the propeller shaft or to feed air into the hub through a slip ring making wiping contact with the hub, which is structurally more complex.

8 Claims, 10 Drawing Figures

MULTI-BLADED PROPELLER AND SHAFT ASSEMBLY

FIELD OF THE INVENTION

This invention relates to a multi-bladed propeller and shaft assembly in which air can be fed to the propeller blades to suppress cavitation.

BACKGROUND TO THE INVENTION

Cavitation at a rotating marine propeller produces undesirable effects; the two principal ones being noise that is transmitted through the water and erosion of the blade material. In many ships it has been the conventional practice to pump air down the drive shaft for the propeller and to discharge it from holes around the blade at a controlled pressure and flow rate. The air has traditionally been fed from an inboard compressor through a slip ring and down the whole length of the shaft, but this arrangement suffers from a number of disadvantages. The air feed arrangements require a multiplicity of inter-section joints, all of which have to be sealed. Hydraulic systems may also pass down the shaft, and a loss of integrity of the air supply can give rise to problem with these systems. It has therefore been desired to deliver the air at a slip ring located outside the ship's hull, possibly in a space between the propeller and the aftmost shaft bearing, with the air delivered through a bearing support bracket such as a so called A-bracket by a route well separated from other vital systems, thereby resulting in a more economic installation having fewer serviceability problems.

A solution to this problem described in No. GB-A-2050278 is to locate a split slip-ring about the shaft with two annular sealing rings in the aft face thereof wiping against the forward face of the propeller assembly. The sealing rings are made of a composition comprising a phenolic resin and asbestos and a passage in the propeller hub leading to the propeller blades rotates in the annulus between the sealing rings, thereby giving a seal that is air-tight and maintains its integrity upon radial and axial movement of the propeller. But the arrangement described is relatively complex.

SUMMARY OF THE INVENTION

It is an object of this invention to provide a similar air delivery facility that is less complex in construction but is at least equally effective.

Broadly stated the invention provides a multi-bladed propeller and shaft assembly in which air can be fed to the propeller blades to suppress the effects of cavitation including:

a shaft leading to the multi-bladed propeller;

a sleeve on the shaft formed with radial and axial passages leading to the respective blades;

slip ring means supported in an anit-rotation device allowing the shaft sleeve to rotate within axially spaced bearings in the slip ring and provided with axially spaced air seals together defining with a body of said slip ring means an annular spaced within which said radial passages rotate, said seals being formed as a multiplicity of arcuate segments resiliently biased towards the sleeve and having overlapping or otherwise movably sealed end face portions to maintain pressure-tightness, and said body having a radial flow passage for admission of air under pressure to said annular space; and a flexible fluid connector connecting the radial flow passage to an air supply line leading from the hull structure.

BRIEF DESCRIPTION OF THE DRAWINGS

Various embodiments of the invention will no be described, by way of example only, with reference to the accompanying drawings, in which.

DETAILS DESCRIPTION OF PREFERRED EMBODIMENT

Figure 1:
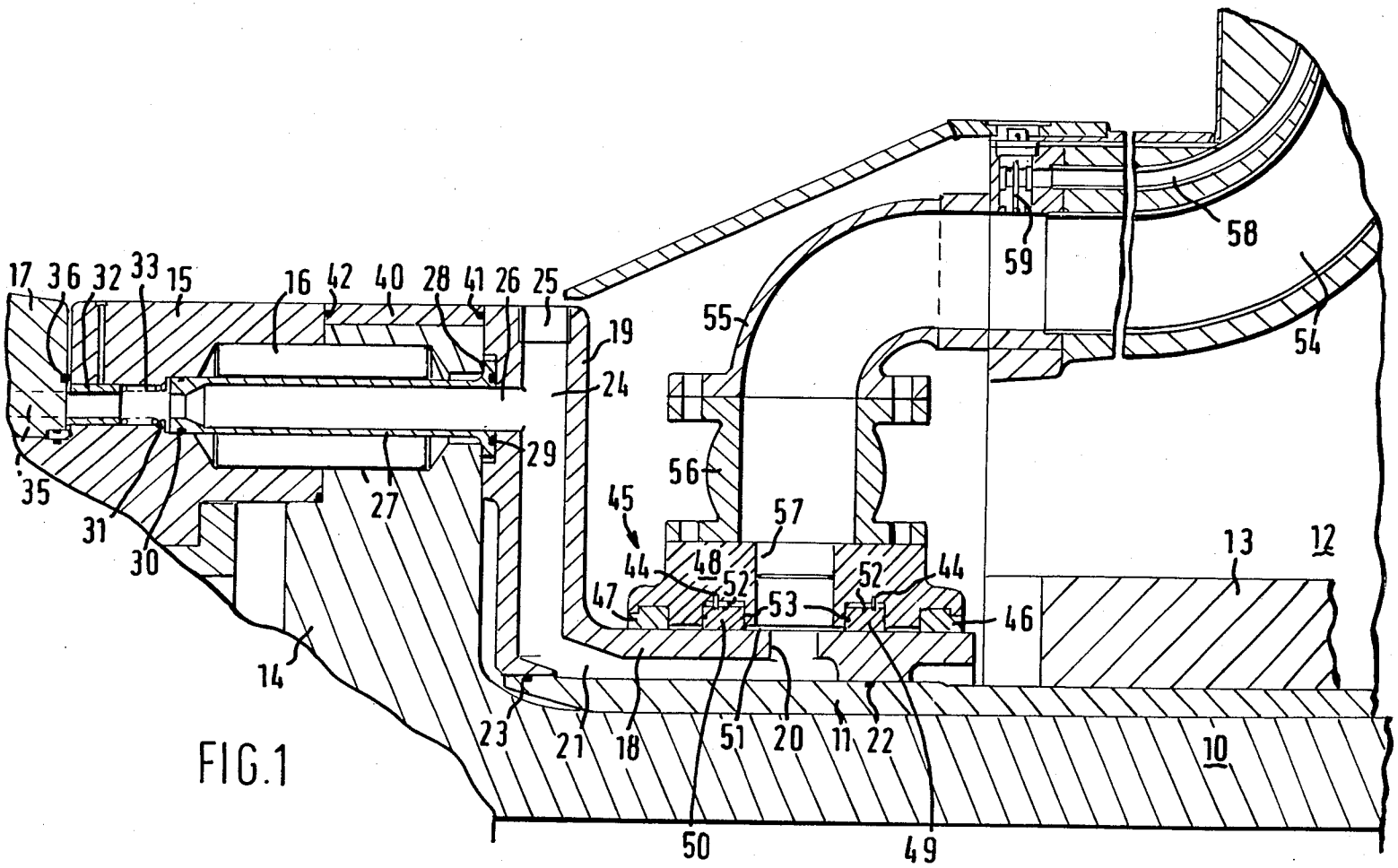
FIG. 1 is a side section of parts of an A-bracket, tailshaft and propeller hub assembly showing an air supply slip-ring according to the invention in association with a controllable pitch propeller.
Figure 2:
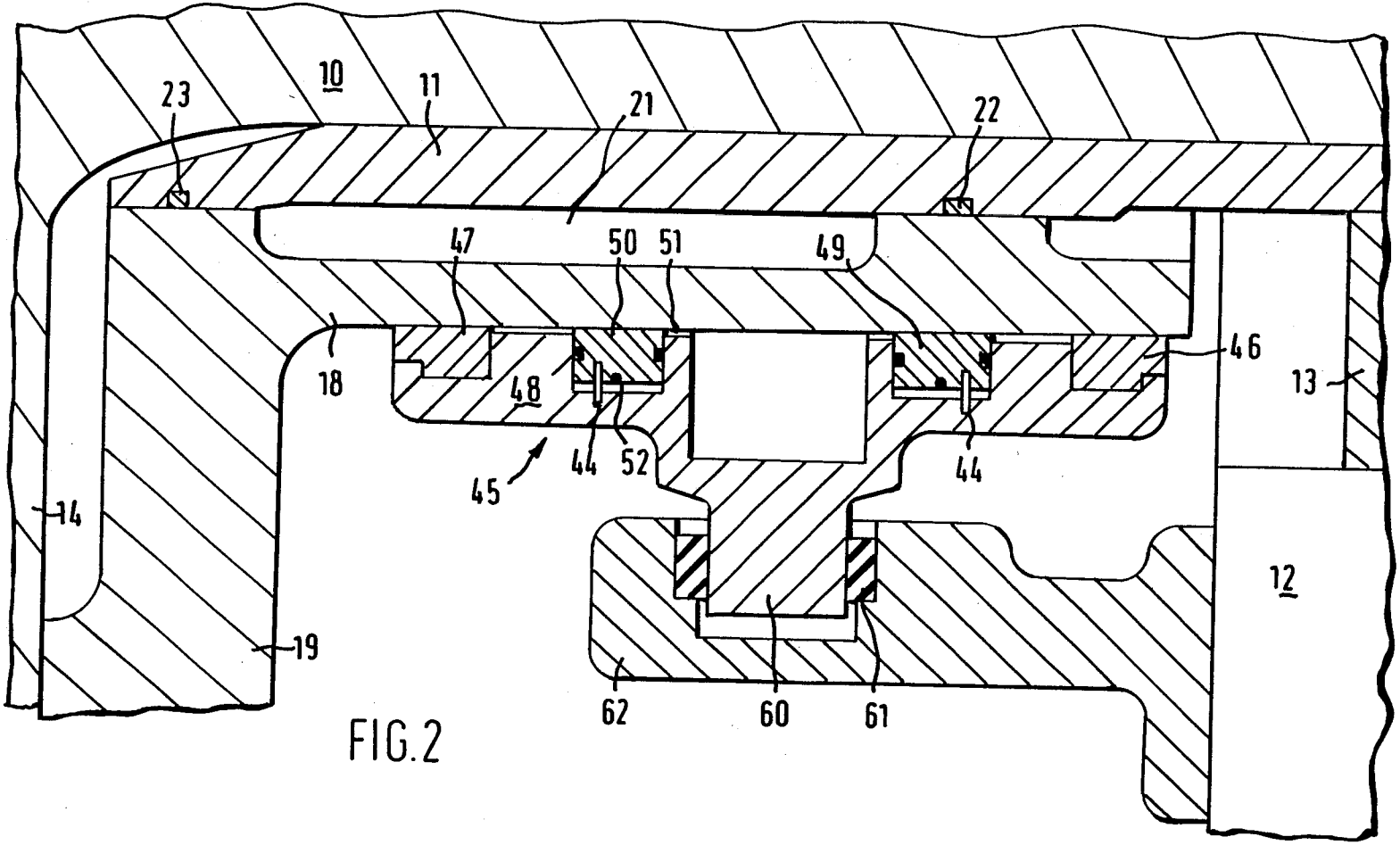
FIG. 2 is another section of a part of the arrangement shown in FIG. 1 showing the slip ring device of FIG. 1 held by an anti-rotation device.
Figure 3:
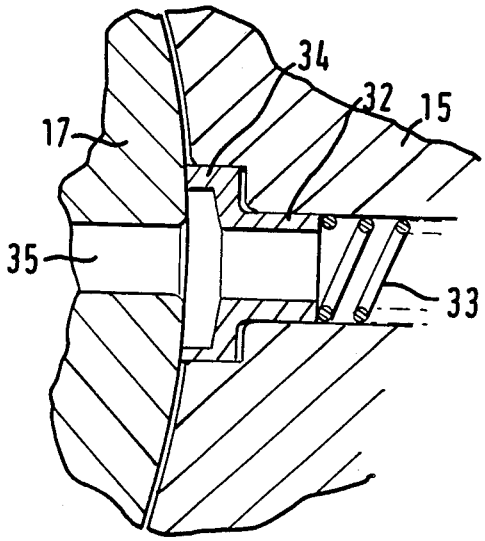
FIG. 3 is a horizontal section adjacent to the periphery of a propeller blade showing an air delivery mouthpiece.

In FIGS. 1–3 a tailshaft 10 having an inner sleeve 11 thereon is supported beneath the hull of a vessel by means of an A-bracket 12 that supports a shaft bearing 13. The tailshaft 10 extends aft of the bearing 13 and terminates in a tail flange 14 that is attached to a propeller hub body by means of fixing bolts (not shown) and by means of driving dowels 16 that transmit the driving torque from the flange 14 to the hub body 15. The propeller is of variable pitch and has blades 17 mounted for rotation in the hub body 15 so that the angle of each blade may be varied. On the sleeve 11 there is mounted an outer sleeve 18 terminating in a flange 19 that is fastened to the forward face of the tail flange 14. Radial inlet passages 20 in the cylindrical side surface of the sleeve 18 lead to axial flow passages 21 sealed at their ends by forward and aft seals 22, 23 let into the inner sleeve 11. The passages 21 lead to radial passages 24 drilled in the flange 19 and closed at their outer ends by means of plugs 25. Fluid from the radial passages 24 is discharged through outlet passages 26 in the aft face of the flange 19 into liners 27 that lead through the flange 14, through the driving dowels 16 which are annular in section, and into the hub body 15. The forward end of each liner 27 is flanged at 28 to mate with a recess in the aft face of the flange 19 about the passage 26 and is fluid-tightly sealed by means of an O-ring 29 let into the face of the flange 28. The aft end of the liner 27 is sealed to the hub body 15 by means of an O-ring 30.

The hub body 15 is formed with a forward bore into which the dowel 16 and liner 27 fit that is separated from an aft bore leading to the blade periphery by means of a shoulder 31. In the aft bore a mouthpiece 32 is urged by compression spring 33 against the periphery of the blade 17, the shoulder 31 serving to provide an abutment for the spring 33. The mouth 34 of the mouthpiece 32 is generally rectangular in end view with its major direction parallel to the direction of rotation of the blade 17 in the hub body 15 whereby fluid communication between the hub bore and a bore 35 in the blade 17 is maintained over the relatively small range of pitch angles at which air fed to the blades gives desirable results. Thus when the blades 17 are in the working pitch range air or other fluid fed into the inlet 20 passes along passages 21, 24, 26, through the hollow dowels 16 into the hub body 15 from which it is fed via mouthpieces 32 into the channels 35 and thence to the blades. An O-ring 36 in the blade periphery seals against the hub body 15 to prevent seawater ingress to the interface between the mouthpiece 32 and the blade periphery, thereby obviating marine growth. An outer ring 40 on the flange 14 provides both protection against sea-water ingress to the flange 14 and a smooth external profile between the flange 19 and the hub body 15 and has O-rings 41, 42 in its end faces to prevent seawater ingress.

A slip ring assembly generally indicated by the reference numeral 45 is supported for rotation on the outer sleeve 18 by means of fore and aft split bearings 46, 47 in a housing 48. A pair of axially spaced air seals 49, 50 are also supported in the housing 48 for wiping contact with the sleeve 18, and they define therewith an annular space 51 within which the inlet passage 20 rotates. The air seals are segmented and the segments are urged into contact with the sleeve 18 by means of garter springs 52. The inner faces of the seals 49, 50 are sealed to the housing 48 by means of O-rings 53 accommodated in channels in said side faces. Anti-rotation pins 44 prevent the individual segments of the seals 49, 50 from rotating in the housing 48. Air is fed down the A-bracket through feed pipe 54 that leads through elbow 55 to a coupling or "bellows" 56 of resiliently flexible material that is bolted to the housing 48, whereby air can be fed down the A-bracket into the bellows 56 and thence via radial bore 57 in the housing 48 to the annular space 51. It may be desirable to feed water to the seals 49, 50 to act as lubricant, and for this purpose the A-bracket 12 is further provided with a water feed pipe 58 that communicates via injection nozzle 59 with the air feed pipe 54. This method of feeding water is, however, less preferred than a method where water is feed direct to the seals as described below.

The slip ring is restrained from rotating about the outer sleeve 18 by means of an anti-rotation device, and a preferred such device is illustrated in FIG. 2. The housing 48 is provided with one or more radially projecting spigots 60 that are held by rubber bushes 61 in anti-rotation arms 62 that are bolted to the A-bracket 12.

Figure 4C:
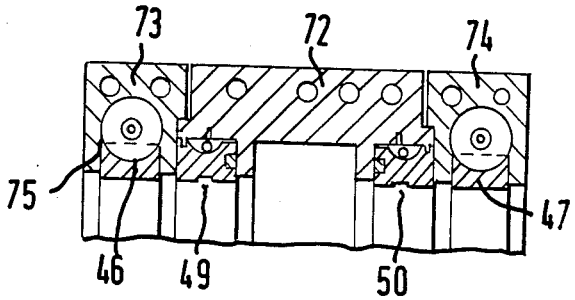
FIG. 4*a*–4*c* are respectively side, end and sectional views of the slip ring assembly, the section being taken on the line A—A of FIG. 4*b;*
Figure 4A:
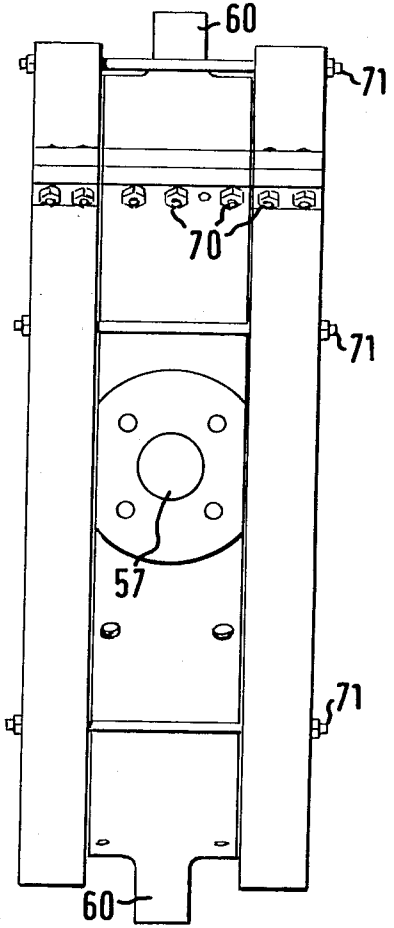
Figure 4B:
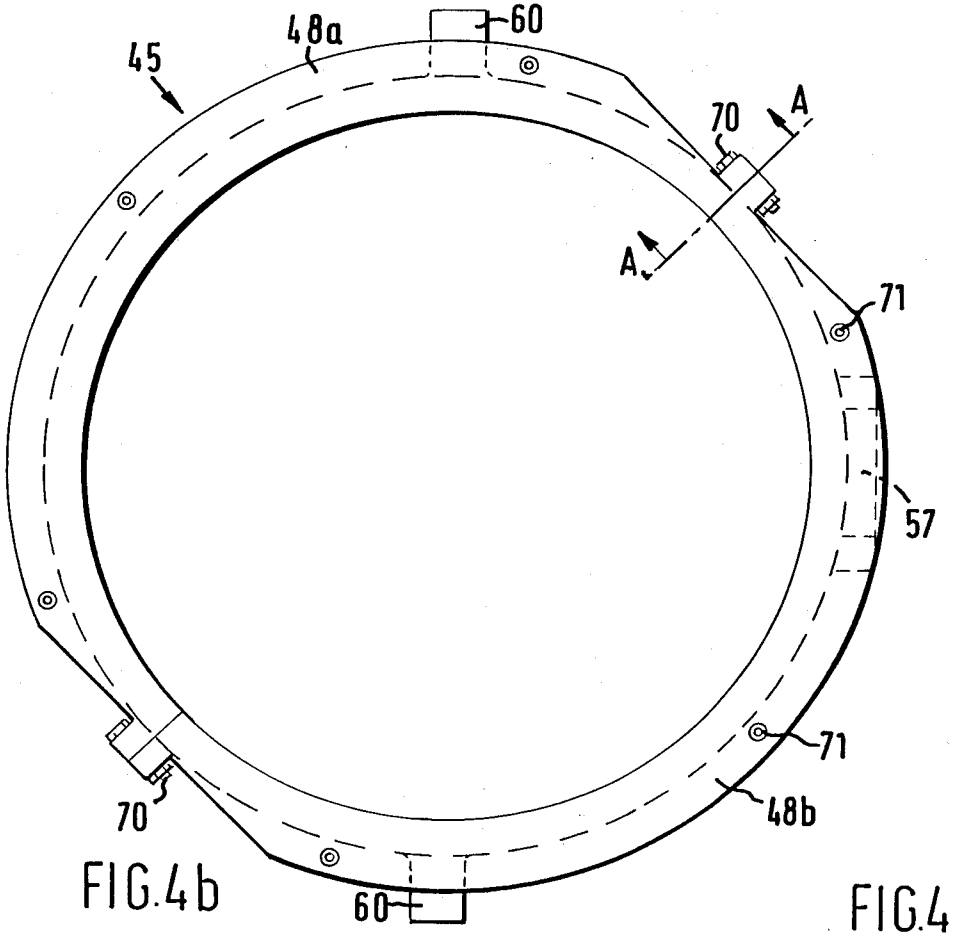

The slip ring assembly 45 is shown in more detail in FIGS. 4*a*–4*c* and is seen to consist of a housing formed in halves 48*a*, 48*b* that are flanged at their ends and are secured together by bolts 70 through the flanges. The housing is formed of three coaxial rings fastened together by means of bolts 71 with a central ring 72 recessed at its forward and aft faces to define with outer rings 73, 74 channels that receive the air seals 49, 50, each outer ring 73, 74 being formed with a channel that receives one of the bearings 46, 47. Each bearing 46, 47 is formed in two halves that are retained in its respective half outer ring by end washers 75 that locate against the end faces of the half ring.

The individual segments of the seals 49, 50 which are shown in FIGS. 5–7 and 8 have overlapping features on either end to minimise the potential leakage of air to the surrounding water. The sleeve 18 is surrounded by six segments 80 each occupying a 60 degree arc and each provided at one end with a tongue 81 that locates in a socket 82 of an adjoining segment to seal the segments one to another. The outer surfaces of the segments are recessed at 83 to accommodate a garter spring 52 and a number of radial passages 84 through the segments allow passage of lubricating water.

Figure 5:
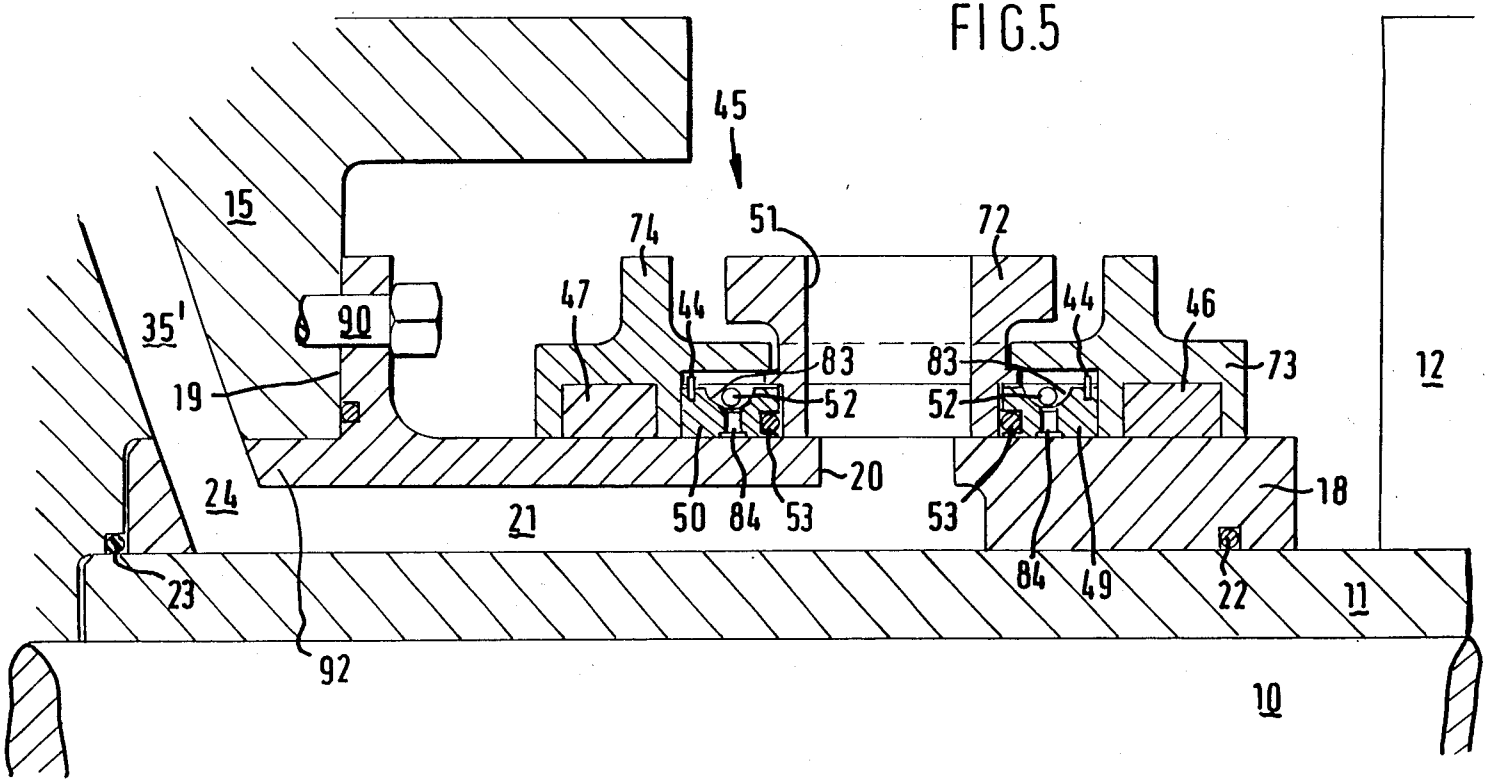
FIGS. 5, 6 and 7 show a second embodiment of the invention, being respectively a side section of an A-bracket, fixed pitch propeller and slip ring device, a section of the slip ring device showing the water supply thereto, and a section showing the axial clamping thereof.
Figure 6:
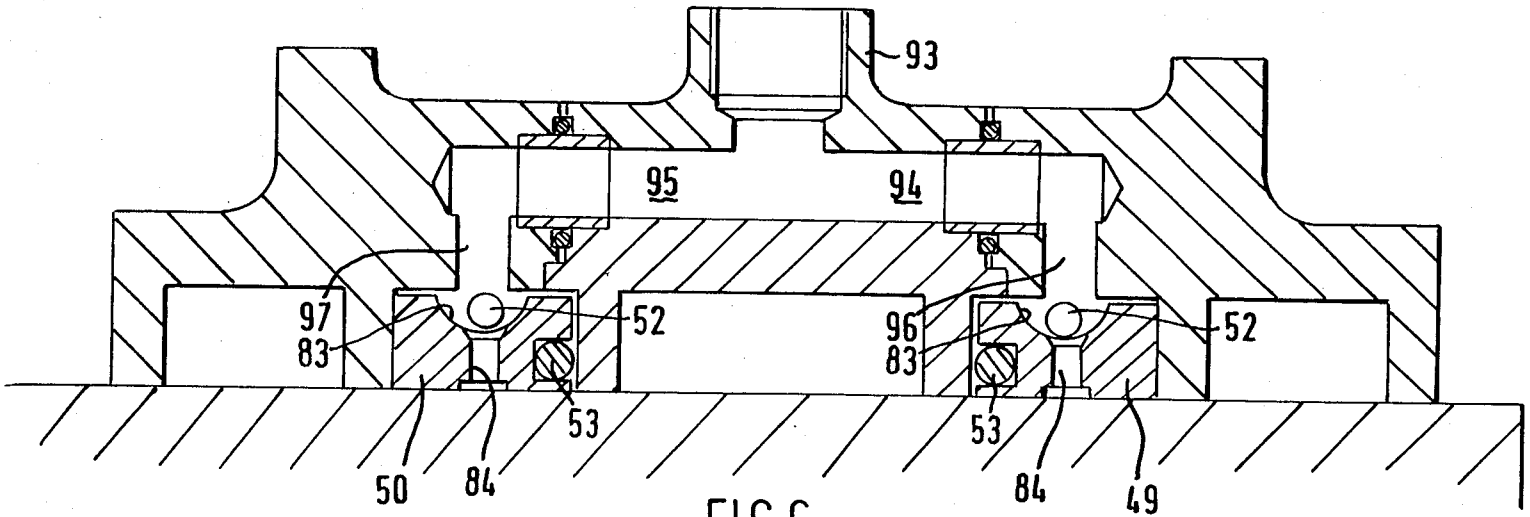
Figures 7, 8:
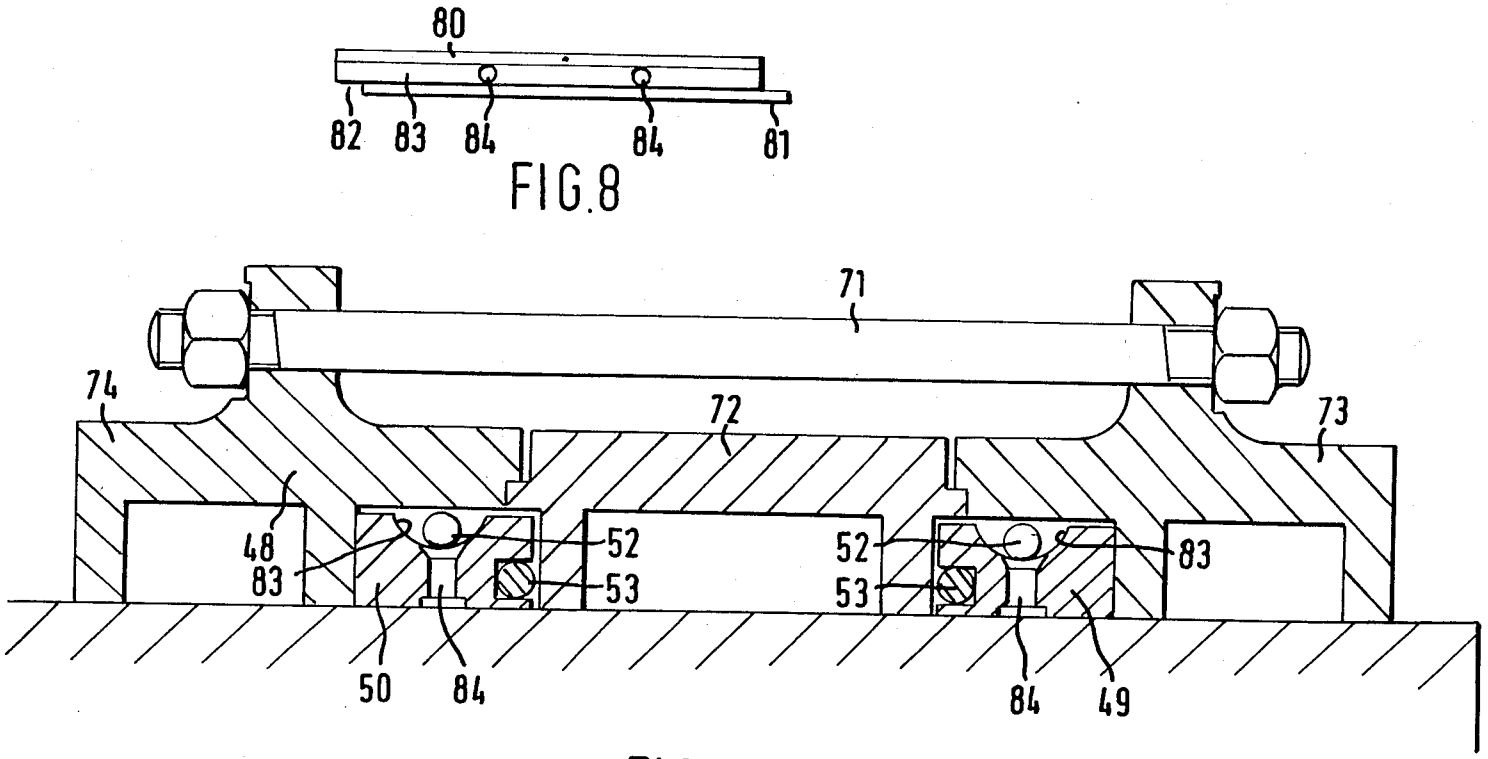
FIG. 8 is a top view of a single arcuate segment forming part of an air seal.

A preferred construction of seal housing assembly is shown in FIGS. 5, 6 and 7 in the context of a fixed pitch propeller. The arrangement is generally similar to that of FIG. 1 except that the tailshaft 10 is not flanged and the hub body 15 is bolted directly to the outer sleeve flange 19 by means of bolts 90, the radial passages 24 leading direct into passages 35' leading through the hub body 15 to the blades. An aft extension 92 of the sleeve 18 fits within a recess in the hub 15, being approximately coextensive with the inner sleeve 11. The water supply from the A-bracket 12 to the seals 49, 50 is shown in FIG. 6. The water feed is through a separate pipe that enters the housing 48 at a radial position spaced from the bore 57 via an inlet 93 that branches to fore and aft axial channels 94, 95 leading through radial channels 96, 97 to the rear face of respective seals 49, 50, the radial drilling 84 in the seals serving to lead the water to the working face of the seals.

It will be appreciated that various modifications may be made to the embodiments described herein without departing from the invention, the scope of which is defined in the appended claims.

I claim:

1. A multi-bladed propeller and shaft assembly for a hull structure in which air can be fed to the propeller blades to suppress the effects of cavitation characterized by:

a shaft leading to the multi-bladed propeller;

a sleeve on the shaft formed with passages leading to the respective blades and with inlets to the passages;

slip ring means supported in an anti-rotation device and having a housing;

axially spaced bearing in the slip ring means within which the shaft sleeve rotates;

axially spaced air seals in the slip ring means together defining with the housing of said slip ring means an annular space within which inlets to said passages rotate, said seals being formed as a multiplicity of arcuate segments resiliently biased towards the sleeve and having movably sealed end face portions to maintain pressure-tightness;

a radial flow passage defined by portions of the housing of the slip ring means for admission of air under pressure to said annular space;

a flexible fluid connector connecting the radial flow passage to an air supply line leading from the hull structure; and means for supplying water to the seals and bearings at at least the air supply pressure for cooling and/or lubrication thereof.

2. An assembly as claimed in claim 1, wherein the several segments of each seal are urged towards the shaft by means of garter spring means and each segment is formed with end lap joint means that overlap end lap joint means of adjoining segments to provide said movably sealed end face portions.

3. An assembly as claimed in claim 1, wherein the slip ring means is restrained to follow any radial movement of the propeller shaft to maintain alignments irrespective of shaft attitude or wear-down of main bearings.

4. An assembly as claimed in claim 1, wherein anti-rotation pegs engage between the housing and the seal segments prevent rotation thereof, each seal is received in a groove of generally channel-section in the housing and O-ring means in an end face of each seal that is exposed to air under pressure seals against the channel to prevent escape of air behind the seal and the bearings engage plain regions of the sleeve so that the sleeve can move axially through the slip ring as the shaft length alters.

5. An assembly as claimed in claim 1, wherein the sleeve is formed with axial passages that terminate in radial passages leading to the respective blades, a blade hub of the propeller being connected to the shaft by means of dowels socketed into the hub and an end flange of the shaft, and the radial passages lead to the blades through said dowels.

6. An assembly according to claim 1, wherein the slip ring is resiliently restrained against rotation at a single point on its circumference.

7. A multi-bladed propeller and shaft assembly for a hull structure in which air can be fed to the propeller blades to suppress the effects of cavitation characterized by:

a shaft leading to the multi-bladed propeller;

a sleeve on the shaft formed with passages leading to the respective blades;

slip ring means supported in an anti-rotation device allowing the shaft sleeve to rotate within axially spaced bearings in the slip ring means and provided with axially spaced air seals together defining with a housing of said slip ring means an annular space within which inlets to said passages rotate, said seals being formed as a multiplicity of arcuate segments resiliently biased towards the sleeve and having movably sealed end face portions to maintain pressure-tightness, and said housing having a radial flow passage for admission of air under pressure to said annular space;

a flexible fluid connector connecting the radial flow passage to an air supply line leading from the hull structure;

the sleeve being formed with axial passages that terminate in radial passages leading to the respective blades, a blade hub of the propeller being connected to the shaft by means of dowels socketed into the hub and an end flange of the shaft, and the radial passages leading to the blades through said dowels;

the blade being rotatably supported in the hub, the air passages leading to the blade periphery being connected thereto by means of spring loaded mouthpieces such that the connection to the blade is maintained over a range of blade angular positions.

8. An assembly according to claim 7, wherein the periphery of each blade is provided with an O-ring that seals against the hub to prevent seawater flow around the interface between the mouthpiece and the blade periphery.

* * * * *